United States Patent [19]

Hashimoto et al.

[11] Patent Number: 4,559,007

[45] Date of Patent: Dec. 17, 1985

[54] FUEL BURNING METHOD IN HEATING FURNACE

[75] Inventors: Mitsuo Hashimoto; Yasuo Watanabe; Fumio Mama; Akinori Odan, all of Yokohama, Japan

[73] Assignee: Nippon Petroleum Refining Company, Limited, Tokyo, Japan

[21] Appl. No.: 318,066

[22] Filed: Nov. 4, 1981

[30] Foreign Application Priority Data

| | | | |
|---|---|---|---|
| Nov. 4, 1980 | [JP] | Japan | 55-153935 |
| Nov. 4, 1980 | [JP] | Japan | 55-153936 |
| Nov. 4, 1980 | [JP] | Japan | 55-153937 |

[51] Int. Cl.[4] ..... F23J 5/00

[52] U.S. Cl. ..... 431/4; 431/242; 431/126; 110/345; 110/343

[58] Field of Search ..... 431/3, 4, 242, 126; 110/342–345; 44/4, 78, 71, 72; 423/210 C

[56] References Cited

U.S. PATENT DOCUMENTS

| | | | |
|---|---|---|---|
| 2,930,681 | 3/1960 | Barusch | 44/78 X |
| 3,746,498 | 7/1973 | Stengel | 431/4 |
| 3,826,080 | 7/1974 | De Corso et al. | 431/4 X |
| 4,105,418 | 8/1978 | Mohnhaupt | 44/78 |
| 4,181,705 | 1/1980 | Gumerman | 110/345 X |
| 4,213,501 | 7/1980 | Pfeiffer et al. | 431/242 X |

*Primary Examiner*—James C. Yeung

*Attorney, Agent, or Firm*—Scully, Scott, Murphy & Presser

[57] ABSTRACT

The concentration of nitrogen oxides contained in exhaust combustion gases is decreased by feeding into the combustion system within a heating furnace the combination of an ammonium compound and a phenol compound, the combination of Fluid Catalytic Cracking gasoline tank bottom water or water obtained after washing Fluid Catalytic Cracking gasoline and an ammonium compound, or FCC overhead condensate.

3 Claims, 3 Drawing Figures

FUEL BURNING METHOD IN HEATING FURNACE

BACKGROUND OF THE INVENTION

This invention relates to a fuel burning method in a heating furnace and more particularly to a fuel burning method in a heating furnace for reducing the concentration of nitrogen oxides contained in the combustion gas exhausted from the furnace.

Various methods have heretofore been proposed for reducing the concentration of nitrogen oxides ($NO_x$) contained in exhausted combustion gases. These methods are broadly classified into a method wherein an exhausted combustion gas is treated to reduce the concentration of NOx contained therein, and a method wherein the production itself of NOx is suppressed by improving fuel burning means. The former method is further classified into (a) a method not using a catalyst and (b) a method using a catalyst, while the latter method is further classified into (c) a method for improving burning conditions themselves on the basis of burner types, oxygen introduction, exhaust gas recycling, etc. and (d) a method wherein ancillary materials are fed at the time of combustion. This invention concerns an improved fuel burning method as an improvement from the method (d) just mentioned wherein ancillary materials are fed to suppress the production of NOx.

Typical of the above method (a) is a method (see Japanese Patent Publication No. 35908/75) wherein an ammonium compound is mixed with an exhaust gas at a high temperature ranging from 1600° to 2000° F. in the presence of a sufficient amount of oxygen. But this method is disadvantageous in that a fairly large amount of ammonia remains in the treated exhaust gas and in that if the temperature of the exhaust gas is low, it must be heated to raise its temperature. As to the above method (b), there have been proposed a very large number of techniques, but none of them have proved to be satisfactory in the durability and heat resistance of the catalysts used. The wet system also involves a problem in point of durability of a catalyst solution used therein. The above method (c) does not use an ancillary material and as the case may be it permits the use of an existing burning apparatus as it is, but the effect of reduction in the amount of NOx is not considered satisfactory. As to the above method (d), there have heretofore been known a method wherein water and alcohol are added and a method wherein a fuel is made into an emulsion by adding a surface active agent as the case may be. But a satisfactory result is not obtainable, either, and particularly in the case of an emulsified fuel, its preparation and storage are troublesome. There have also been proposed the addition of various metal salts (see, for example, Japanese Patent Laying Open Print No. 117001/78) and the addition of sodium thiosulfate (see Japanese Patent Publication No. 35400/80), but a drawback is unavoidable because metals and sulfur are contained in the exhaust gas.

SUMMARY OF THE INVENTION

It is an object of this invention to eliminate the foregoing disadvantages associated with the prior art.

It is another object of this invention to provide a very economical fuel burning method in a heating furnace capable of effectively suppressing the production of NOx.

Other objects and advantages of this invention will become apparent from the following description.

The aforesaid objects of this invention can be achieved by a fuel burning method in a heating furnace wherein a liquid and/or gaseous fuel is fed to a burner mounted at the lower portion of the heating furnace and is thereby allowed to burn to heat a substance to a temperature in the range of from 400° to 800° C., characterized in that there is fed to the combustion system at least one member selected from the group consisting of (a) an ammonium compound and a phenol compound, (b) Fluid Catalytic Cracking (hereinafter FCC) gasoline, tank bottom water or water obtained after washing FCC gasoline and an ammonium compound and (c) FCC overhead condensate.

DETAILED DESCRIPTION OF THE INVENTION

Figure 1:
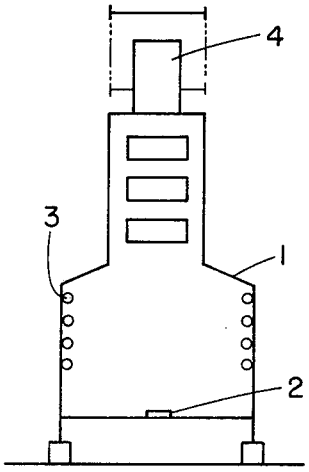

Typical of the liquid fuel referred to herein are various petroleums such as heavy oil, light oil, kerosene, naphtha, residual oil in atmospheric distillation, residual oil in vacuum distillation and crude oil; hydrocarbon fuels such as a liquefied and extracted oil of coal; and these oils incorporating a powdered coal. On the other hand, typical of the gaseous fuel referred to herein are gaseous hydrocarbons such as methane, ethane, propane and butane; carbon monoxide; and mixtures consisting principally of these substances. There also may be used natural gases and mixtures of gaseous hydrocarbons exhausted from petroleum refineries and petrochemical factories.

According to this invention, the above fuels are fed to a burner mounted at the lower portion of a heating furnace and are thereby allowed to burn. The heating furnace can be any of several types of heating furnaces, e.g. box type, cell type, vertical box type and vertical cylinder type heating furnaces, provided at the bottom or at a lower side portion thereof with one or two or more burners.

On the side wall and/or upper portion in the furnace there is disposed a heating pipe through which there passes a substance to be heated. According to the fuel burning method in a heating furnace of this invention, a substance to be heated is subjected to heating at a temperature in the range of from 400° to 800° C., preferably from 500° to 700° C. Lower temperatures are impractical, while higher temperatures are not effective. That is, in a conventional boiler for heating water at around 1000° C. or higher to obtain a high-pressure steam, it is difficult to attain a remarkable reduction in the concentration of NOx by the application of the method of this invention.

In the fuel combustion in the heating furnaces as referred to herein, if this invention is not applied, there usually is produced a fairly large amount of NOx and, for example, 80 to 300 ppm of NOx is contained in exhaust gases, although this differs according to the structure of furnace, burning conditions and the kind of fuel. But if this invention is applied, the production of NOx can be effectively suppressed and the NOx concentration in exhaust gases can be decreased.

It is a significant feature of this invention to feed the foregoing specific components into the combustion system, and this feeding is preferably attained by mixing those components with the foregoing fuels or by feeding them near the foregoing burner(s). The component to be added in the invention is the foregoing (a), (b) or (c). The component (a) is the combination of an ammonium compound and a phenol compound. The ammonium compound as referred to herein indicates ammonia or a compound which on heating produces ammonia relatively easily, typical of which are ammonium carbonate, ammonium formate, ammonium acetate and ammonium oxalate, which are preferably used in the form of an aqueous solution. From the standpoint of cost and handling, a gaseous ammonia and an aqueous ammonia are most suitable. The phenol compound used together with the ammonium compound is a compound having a phenolic hydroxyl group, typical of which are phenol, cresols and catechols, which are preferably used in the form of a mixture with water from the standpoint of their handling. One or two or more such phenol compounds may be used. In the case of using an aqueous phenol compound solution, it may be mixed with an aqueous solution of an ammonium compound as referred to above, or there may be used a mixture of water with both ammonium compound and phenol compound.

In the case of using an aqueous ammonium compound solution, the concentration of the ammonium compound is not specially limited, but usually it is 1% to 30%, preferably 3% to 15%, by weight, while in the case of using an aqueous phenol compound solution, the concentration of the phenol compound usually is 100 to 5000 ppm, preferably 500 to 3000 ppm.

The amount of an ammonium compound and that of a phenol compound to be fed into a heating furnace differ according to the structure of the furnace, the kind of fuel and burning conditions, but the concentration of NOx in exhaust gases during combustion in the absence of those compounds can be determined in advance, and for each mole of the so-determined NOx there may be fed the ammonium compound in an amount usually not less than 0.5 mole, preferably 1 to 5 moles, and the phenol compound in an amount usually not less than 0.001 mole, preferably 0.01 to 0.1 mole. Too small amounts of both are less effective in suppressing the production of NOx, while too large amounts are disadvantageous in point of cost.

As to the component (a) used in the invention, it is essential that the ammonium compound and the phenol compound be fed simultaneously into a heating furnace. As shown in comparative examples as will be described later, in the case of using either compound alone, it is impossible to fully attain such a combustion as exhausts a sufficiently decreased amount of NOx while effectively suppressing the production of NOx.

The component (b) to be added in the invention is the combination of FCC gasoline tank bottom water or water obtained after washing FCC gasoline and an ammonium compound. The FCC gasoline tank bottom water used in the invention will be explained hereinunder.

Fluid catalytic cracking (herein referred to as FCC) is well known as a method of obtaining lighter petroleums by subjecting heavy petroleums to fluid catalytic cracking using a granular catalyst, and various outlines are described, for example, in the "Petroleum Handbook," Sekiyu Shunju Sha, (1977), pp. 283 to 287 and the "Petroleum Processing Handbook", McGraw-Hill, Inc., (1967), pp. 3-2 to 3-7.

Description of FCC reaction column and reaction system is here omitted, but no matter which reaction system may be used, a mixture produced by cracking and discharged from the top of the reaction column is fed to a distillation column and is thereby separated into light gases, gasoline distillate, light oil distillate and residue. The gasoline distillate is stored in a tank and is used as a gasoline product usually as it is and as the case may be after removal of light fractions of $C_4$ or less and washing with an alkali or water. In some cases, moreover, this gasoline is mixed with a gasoline distillate obtained by another method, e.g. a straight-run gasoline, a catalytic reformate or a thermally cracked gasoline, and a stabilizer, a coloring agent or other additives are sometimes incorporated therein. These FCC gasolines are stored in a tank. In case this tank is used over a period of time, a water layer is in many cases formed at the bottom of the tank. The FCC gasoline tank bottom water as referred to herein indicates this water layer recovered from the bottom of a tank containing FCC gasoline.

Water obtained after washing FCC gasoline as referred to herein indicates water recovered after used for washing FCC gasoline or FCC gasoline-containing solution. Usually, FCC gasoline is contacted with water and then settled to separate an upper layer of washed FCC gasoline and a lower layer of used water.

Water thus separated is used in this invention. FCC gasoline may be washed with water containing ammonia. In this case, water obtained after washing the FCC gasoline can be used without adding further ammonia thereto.

The ammonium compound in the component (b) is the same as that in the component (a). The ammonium compound may be added in the same manner as the feeding of the aforesaid FCC gasoline tank bottom water or water obtained after washing FCC gasoline, but it is preferable that the ammonium compound be added beforehand to such a tank bottom water or used water and be fed together.

The amount of the ammonium compound in the component (b) to be added differs according to the structure of a heating furnace, the kind of fuel and burning conditions, but the concentration of NOx in an exhaust gases during combustion not according to this invention can be determined in advance, and for each mole of the so-determined NOx there may be added usually not less than 0.5 mole, preferably 1 to 5 moles, of the ammonium compound. In the case of feeding the ammonium compound by adding it in advance to the FCC gasoline tank bottom water or water obtained after washing FCC gasoline, it is convenient to adjust the concentration of the ammonium compound in the mixture usually to 1% to 30% by weight, preferably 3% to 15%, by weight.

The amount of the FCC gasoline tank bottom water or water obtained after washing FCC gasoline to be fed into a heating furnace differs according to the structure of the furnace, the kind of fuel and burning conditions, but usually it is 1% to 30%, preferably 5% to 20%, by weight based on the fuel to be burned.

The component (c) to be used in the invention is FCC overhead condensate. In the distillation of the foregoing mixture discharged from the top of FCC reaction column, the column top distillate is cooled and fed to a drum, wherein uncondensed gases are separated, while a condensate is partially recycled as a reflux to the column top and partially recovered as a product gasoline distillate. In this case, a water layer consisting principally of condensed water is formed at the lower portion of the drum. Generally, this water layer is regularly withdrawn and discharged as waste water. The water thus condensed in the drum and then discharged is the overhead condensate as referred to herein.

In such a discharged water layer there usually are incorporated fairly large amounts of organic substances, so if this water layer is discarded as it is, it will cause an environmental pollution, and therefore these organic substances are removed before discard of the water layer. For removing those organic substances there sometimes is applied a steam stripping operation, wherein the aforesaid discharged water is fed to a stripping column while steam is introduced into the lower portion of the column for stripping mainly the organic substances. A gaseous matter containing a large amount of steam discharged from the upper portion of the stripping column is condensed by cooling and introduced into a drum whereby a water layer containing a large amount of water is formed. This water layer also corresponds to the overhead condensate as referred to herein and it is effectively employable in this invention.

The main component of these overhead condensates is water, and this water is formed mainly from the steam used in steam stripping for removing hydrocarbons adhered to the surface of a granular catalyst in FCC reaction apparatus and also from the steam introduced into a distillation column for effectively performing distillation of the foregoing FCC cracked product.

When feeding the FCC overhead condensate into the furnace, an ammonium compound may be added thereto. The ammonia compound as referred to herein is the same as that in the components (a) and (b). The amount of the overhead condensate to be fed into a heating furnace differs according to the structure of the furnace, the kind of fuel and burning conditions, but usually it is 1% to 30%, preferably 5% to 20%, by weight based on the weight of fuel to be burned.

In case an ammonium compound is added to the overhead condensate, it may be added so that its amount is not more than 30%, preferably 3% to 15%, by weight in terms of its concentration in the overhead condensate. When adding the above amount of the ammonium compound, it may be fed as a separate aqueous solution or ammonia gas without mixing it with the overhead condensate into the furnace according to the feeding method for the overhead condensate.

The FCC tank bottom water or water obtained after washing FCC gasoline usually contains, in addition to water, fairly large amounts, say 1000 ppm or more, of various nitrogen-containing compounds, oxygen-containing compounds and the like which are contained in the FCC gasoline.

Also, the overhead condensates contain, in addition to water, fairly large amounts, say 1000 ppm or more and as the case may be 1% or more, of compounds produced by cracking of heavy oils such as various hydrocarbons and compounds respectively containing nitrogen, sulfur and oxygen. Therefore, they emit an offensive odor and their Chemical Oxygen Demand (COD) values are high, and so they cannot be discharged directly as waste water. For their disposal as waste water it is necessary to apply a purification treatment, and this additional step causes a troublesome operation. This invention effectively utilizes such a waste water even whose discarding is inconvenient, and in this point the present invention is of great industrial significance.

In this invention it is essential that a fuel be burned while feeding to the combustion system at least one member selected from the foregoing components (a), (b) and (c).

The reason why the combustion at a reduced NOx concentration is attainable by feeding the component (a), (b) or (c) into a heating furnace is not clear strictly, but it is presumed that the combustion with an effectively suppressed production of NOx is induced by a synergistic effect of both components of (a), both components of (b) or various compounds of (c) in the combustion system of the fuel concerned.

In the case of feeding the component (a), (b) or (c) as a mixture with a fuel in the invention, it may be mixed with the fuel in advance, or it may be fed by line-blending it into a fuel feeding pipe. In case the component (a), (b) or (c) is fed near a burner, there may be formed an injection port separate from the fuel injection port near the bottom or lower side wall portion of a heating furnace and through this separate injection port it may be fed into the furnace. In this case, it may be fed into or around the flame formed by the burner. According to a preferred way of feeding the component (a), (b) or (c) in the invention, however, when applying the method of the invention to an existing heating furnace, e.g. a heating furnace equipped with plural burners, the component is fed to one or more of the burners without feeding fuel thereto. Since burners are usually disposed symmetrically or at equal intervals, the component is fed near the burners in a relatively uniform manner and it is not necessary to provide an additional feeding device, and therefore such a feeding method is convenient. In the case of constructing a new heating furnace to which the invention is to be applied, it is preferable that one or more feeding ports be formed in an approximately intermediate position between burners at the bottom or lower side wall portion where the burners are to be disposed.

In heating furnaces to which the method of this invention is applied, there are obtained the following advantages in the combustion of fuel:

(1) Fuel combustion at an effectively suppressed production of NOx is attainable.

(2) Ammonia or other component fed is not contained in exhaust gases.

(3) Ammonium compounds and phenol compounds to be fed are less expensive and their amounts to be fed are relatively small.

(4) FCC gasoline tank bottom water, water obtained after washing FCC gasoline and FCC overhead condensate to be fed are difficult to be discarded, but these inconvenient effluents can be utilized effectively.

(5) This method can be applied to conventional existing heating furnaces without installing any complicated particular apparatus thereon.

(6) It is not necessary to change combustion conditions such as feeding rates of fuel and air and furnace temperature when this method is adopted.

(7) In case of establishing a new heating furnace adopting this method, it is not necessary to modify the design of a conventional heating furnace on a large scale.

DRAWINGS

The accompanying drawings illustrate an example of a heating furnace for heating crude oil before its introduction into an atmospheric distillation column to obtain various distillates.

Figure 2:
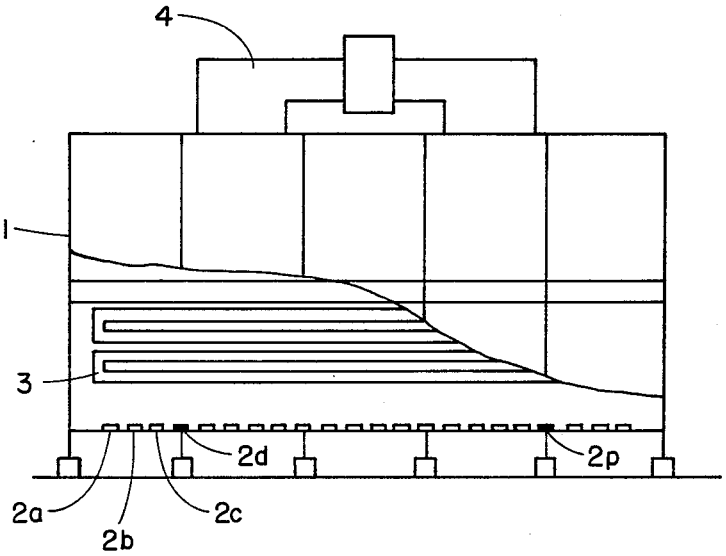

FIGS. 1 and 2 are end and side elevational views of a heating furnace 1 which is equipped with burners 2 (2*a*, 2b, 2c, 2d, . . . ) as illustrated, and a heating pipe 3 for crude oil to be heated is mounted on the furnace wall. Furthermore, a pipe 4 is an outlet for exhaust gases, through which exhaust gases are sampled for determining the concentration of NOx in various burning experiments.

Figure 3:
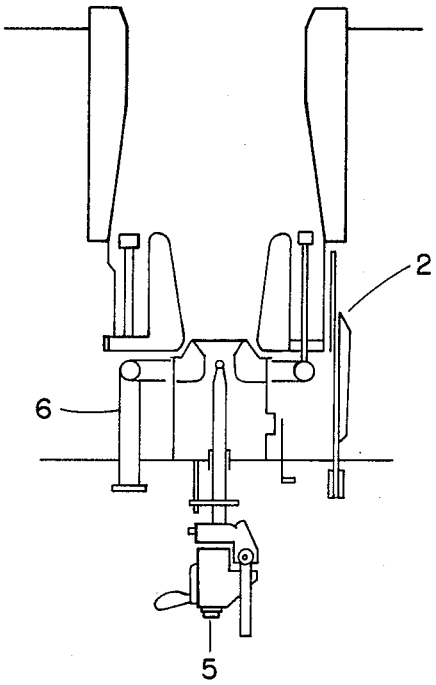

FIG. 3 is a sectional view of the burners 2, in which a liquid fuel (fuel oil C defined in Japanese Industrial Standard JIS K-2205) is fed through a pipe 5, or as the case may be a gaseous fuel is fed through a pipe 6. As the fuel is burned, the surroundings of the heating pipe 3 are heated to the temperature range defined by this invention whereby the crude oil in the heating pipe is heated. Components to be fed according to this invention are introduced through the burners 2d and 2p.

The following examples further illustrate the invention.

EXAMPLE 1 AND COMPARATIVE EXAMPLE 1

Crude oil was heated using the heating furnace shown in FIGS. 1 through 3. The heating furnace 1 used was of a content volume of about 16,500 cubic feet, and the surroundings of the heating pipe 3 were held at about 550° to 650° C. and at a total heat quantity of about 140 MMBtu/hr (British Thermal Units/hr. $\times 10^6$) on the average by the combustion of fuel. Aqueous solutions containing ammonia and a phenol compound at various concentrations were fed through the burners 2d and 2p. Feeding conditions for those aqueous solutions in various experiments and concentrations of NOx in exhaust gases after their feeding are set out in Table-1.

By way of comparison, also with respect to the conventional combustion without feeding any ancillary substance (Run No. 1) and to the case where ammonia water alone was fed (Run No. 2), the results are shown in Table-1.

Reference to Table-1 clearly shows that in the case of feeding the ammonium compound and the phenol compound into the furnace according to the method of this invention, the concentration of NOx in exhaust gases clearly decreases as compared with the case (Run No. 1) where such compounds are not fed, and that in the case of adding ammonia water alone (Run No. 2), the effect of such a decrease in NOx concentration is not obtained.

According to the present working example of this invention, there remain neither ammonia nor phenol compound in the exhaust gases.

TABLE 1

| | Run No. | $O_2$ % | Component concentrations in aqueous solutions fed: ammonia (%) | phenol (ppm) | cresol (ppm) | Amount of aqueous solutions fed (kl/hr) | NOx in exhaust gases (ppm) |
|---|---|---|---|---|---|---|---|
| Comparative | 1 | 6.0 | 0 | 0 | 0 | 0 | 105 |
| Example 1 | 2 | 6.0 | 5.0 | 0 | 0 | 0.2 | 103 |
| Example 1 | 3 | 6.0 | 5.0 | 5000 | 0 | 0.18 | 75 |
| | 4 | 6.0 | 5.0 | 2600 | 0 | 0.23 | 61 |
| | 5 | 6.0 | 4.5 | 850 | 0 | 0.2 | 73 |
| | 6 | 6.0 | 5.0 | 0 | 2500 | 0.2 | 62 |
| | 7 | 6.0 | 5.0 | 0 | 1250 | 0.2 | 62 |
| | 8 | 6.0 | 5.0 | 0 | 620 | 0.2 | 73 |

EXAMPLE 2 AND COMPARATIVE EXAMPLE 2

Using a heating furnace 1 having a content volume of about 16,000 cubic feet, the surroundings of the heating pipe 3 were held at about 550° to 650° C. on the average and at a total heat quantity of about 150 MMBtu/hr by the combustion of fuel whereby a crude oil in the heating pipe 3 was heated. FCC gasoline tank bottom water and an ammonium compound at various concentrations were fed through the burners 2d and 2p. There feeding conditions as well as concentrations of NOx in exhaust gases after the feeding are set out in Table-2.

By way of comparison, also with respect to the conventional combustion without feeding any ancillary substance (Run No. 9) and to the case where ammonia water alone was fed (Run No. 10), the results were shown in Table-2.

Reference to Table-2 clearly shows that in the case of feeding the FCC gasoline tank bottom water and the ammonium compound into the furnace according to the method of this invention, the concentration of NOx in exhaust gases clearly decreases as compared with the case (Run No. 9) where such substances are not fed, and that in the case of adding ammonia water alone (Run No. 10), the effect of such a decrease in NOx concentration is not obtained.

TABLE 2

| | Run No. | Amount of FCC tank bottom water fed (kl/hr) | NOx in exhaust gases (ppm) |
|---|---|---|---|
| Comparative | 9 | 0 | 106 |
| Example 2 | 10*1 | 0 | 105 |
| Example 2 | 11 | 0.1*2 | 66 |
| | 12 | 0.2*2 | 55 |
| | 13 | 0.3*3 | 55 |
| | 14 | 0.4*3 | 54 |

*1A 5% aqueous $NH_4OH$ solution alone was fed at the rate of 0.2 kl/hr.
*2Ammonia water was added to FCC gasoline tank bottom water to adjust the $NH_4OH$ concentration to 5%.
*3Ammonia water was added to FCC gasoline tank bottom water to adjust the $NH_4OH$ concentration to 8%.

EXAMPLE 3 AND COMPARATIVE EXAMPLE 3

Using a heating furnace having a content volume of about 16,000 cubic feet, the surroundings of the heating pipe 3 were held at about 550° to 650° C. on the average and at a total heat quantity of about 150 MMBtu/hr by the combustion of fuel whereby a crude oil in the heating pipe 3 was heated. FCC overhead condensate was fed through the burners 2d and 2p. Feeding conditions for the condensate as well as concentrations of NOx in exhaust gases after the feeding are set out in Table-3.

By way of comparison, also with respect to the conventional combustion without feeding any ancillary substance (Run No. 15) and to the case where ammonia water alone was fed (Run No. 16), the results were shown in Table-3.

Reference to Table-3 clearly shows that in the case of feeding the FCC overhead condensate into the furnace according to the method of this invention, the concentration of NOx in exhaust gases clearly decreases as compared with the case (Run No. 15) where such a condensate is not fed, and that in the case of adding ammonia water alone (Run No. 16), the effect of such a decrease in NOx concentration is not obtained.

TABLE 3

| | Run No. | Amount of FCC overhead condensate fed (kl/hr) | NOx in exhaust gases (ppm) |
|---|---|---|---|
| Comparative Example 3 | 15 | 0 | 105 |
| | 16*[1] | 0 | 103 |
| Example 3 | 17 | 0.1*[2] | 65 |
| | 18 | 0.2*[2] | 50 |
| | 19 | 0.3 | 55 |
| | 20 | 0.2 | 60 |
| | 21 | 0.3*[3] | 50 |

*[1]A 5% aqueous $NH_4OH$ solution was fed at the rate of 0.2 kl/hr.
*[2]FCC overhead condensate was subjected to steam stripping and the condensate thereby obtained was used.
*[3]Ammonia water was added to FCC overhead condensate to adjust the $NH_4OH$ concentration to 5%.

What is claimed is:

1. In a fuel burning method in a heating furnace wherein a substance to be heated is heated at a temperature in the range of from 400° to 800° C. by feeding a liquid fuel and/or gaseous fuel to a burner mounted at the lower portion of the heating furnace and thereat burning the fuel with an abundant supply of oxygen, the improvement which comprises reducing the concentration of nitrogen oxides contained in the combustion gases exhausted from the furnace by feeding into the combustion system the combination of FCC gasoline tank bottom water or water obtained after washing FCC gasoline and an ammonium compound.

2. In a fuel burning method in a heating furnace wherein a substance to be heated is heated at a temperature in the range of from 400° to 800° C. by feeding a liquid fuel and/or a gaseous fuel to a burner mounted at the lower portion of the heating furnace and thereat burning the fuel with an abundant supply of oxygen, the improvement which comprises reducing the concentration of nitrogen oxides contained in the combustion gases exhausted from the furnace by feeding into the combustion system the water portion of the FCC overhead condensate.

3. In a fuel burning method in a heating furnace wherein a substance to be heated is heated at a temperature in the range of from 400° to 800° C. by feeding a liquid fuel and/or a gaseous fuel to a burner mounted at the lower portion of the heating furnace and thereat burning the fuel with an abundant supply of oxygen, the improvement which comprises reducing the concentration of nitrogen oxides contained in the combustion gases exhausted from the furnace by feeding into the combustion system the mixture of the water portion of the FCC overhead condensate and an ammonium compound.

* * * * *